United States Patent [19]

Hollweck

[11] Patent Number: 4,929,922

[45] Date of Patent: May 29, 1990

[54] TEMPERATURE SAFETY DEVICE FOR ELECTRIC DEVICES

[75] Inventor: Walter Hollweck, Heroldsberg, Fed. Rep. of Germany

[73] Assignee: Inter Control Hermann Kohler Elektrik GmbH Fed. Rep. of Germany

[21] Appl. No.: 287,336

[22] Filed: Dec. 20, 1988

[30] Foreign Application Priority Data

Dec. 24, 1987 [DE] Fed. Rep. of Germany ..... 3744238

[51] Int. Cl.[5] ..... H01H 37/76

[52] U.S. Cl. ..... 337/407; 337/403

[58] Field of Search ..... 337/401–409

[56] References Cited

U.S. PATENT DOCUMENTS 4,307,370 12/1981 Hollweck ..... 337/407

*Primary Examiner*—H. Broome

[57] ABSTRACT

A temperature safety device includes an electrically insulative support, electrical connectors extending outwardly of the support, first and second contact elements having first fixed ends connected with the electrical connectors and free ends engageable to provide a switch within the support in series circuit with the electrical connectors. A melt material insert adapted for heat transfer relation with apparatus being protected by the safety device, is included and a mechanical force transfer element is disposed between the insert and the second contact element, applying force thereto to effect closure of the contact elements in part attributable to counter-forces exerted by the contact elements. The device first contact element has a lower directional quantity at its free end than the directional quantity of the second contact element at its free end and the device includes a stop element disposed by the support in confronting relation with the first contact element and coactive therewith upon melting of the insert to limit movement of the first contact element, thereby to enhance opening of the switch and interruption of the series circuit.

13 Claims, 4 Drawing Sheets

TEMPERATURE SAFETY DEVICE FOR ELECTRIC DEVICES

The invention concerns a temperature safety device for electrical devices.

A temperature safety device is known from DE-PS 28 26 205, which essentially consists of an insulating part with electrical connections and contact elements for the production of a current path, has a melt material insert as a thermal trigger, which can be coupled with a heat source, such as the sole of an iron or something similar, for example, via a heat transfer plate, and is provided with a mechanical transfer element with which the melt material insert supports the moving contact against the counter-forces exerted by the two contact elements to keep it in closed contact position and applies the contact closing pressure.

Such temperature safety devices are activated when the temperature of the monitored part exceeds a maximum permissible temperature value of the electrical device equipped with the safety device. The thermally coupled melt material insert begins to flow, because of the force of the contact springs, which are still in the closed position. The transfer element gives way when the melt material insert collapses or melts, and allows separation of the contact elements.

The known temperature safety devices are not unproblematical from various points of view, with regard to their design and their switching behavior. Such temperature safety devices are supposed to be structured as compact as possible, so that they can find room even in relatively small apparatus housings, which means that very little room is available for the swing movement. The usual height of the melt material inserts used is approximately 0.7 mm, so that if a certain safety tolerance is observed, approximately 0.5 mm is available for the swing paths, namely the opening swing path of the moving contact element and the common swing path of the fixed and moving contact, for application of the contact pressure.

Furthermore, it has been shown that the melt material inserts used are subject to a certain aging process. The melt material inserts collapse somewhat as time goes by, under the pressure of the contact springs which acts on them. The more frequently and the closer the temperature of the melt insert comes to the trigger value, the more this aging process progresses. For the temperature safety devices in question, it is necessary for their proper functioning that an opening of the contacts only due to the aging process described, in other words an opening of the contacts before the trigger temperature is reached, does not take place. For this reason, it has been necessary, in the designs according to the state of the art, to provide a certain safety swing path, through which the contacts can pass in the closed position, while maintaining a minimum contact pressure, while the melt material insert collapses due to the aging process.

Because of the spatial conditions in such switches, which have already been mentioned, this safety swing path must be significantly less, however, than the opening swing path through which the moving contact passes when the switch is activated, in other words when the trigger temperature is exceeded and the insert melts as a result.

Another known problem with such switches is cold welding of the contacts. This undesirable process can result in the fact that the contacts do not separate when the melt material insert is activated, and the current path through the switch remains closed, which can have disastrous consequences for the electrical devices being monitored.

The invention is based on the task of constructing a safety switch maintaining compact construction, in such a way that assured opening of the contact distance is guaranteed even if the switch was exposed to higher currents and temperatures for extended periods of time.

For the solution of the problem according to the invention, the recognize that a simple increase of the spring forces of the movement contact has the undesirable effect of an increase in the pressure on the melt material insert, which necessarily leads to a more rapid penetration of the transfer element into the melt material insert in the course of the aging process. Simply increasing the directional quantity of i.e., the spring moment, the moving contact will result in an assured break between the contacts in case of cold welding, but also accelerates the aging process.

The solution according to the invention provides that the fixed contact, which already had a spring force inherent in it according to the state of the art, be given a significantly lower directional quantity than the relatively hard spring moving contact. In order to prevent the soft spring "fixed contact" from being carried along too far by the moving contact with a higher directional quantity as it moves away, and thereby being bent, a stop is arranged to limit the movement of the fixed contact, which stop acts together with the side of the fixed contact facing the melt material insert. This has the result that when the insert responds, the springs pass through a first swing path together — triggered by the total spring forces directed against the melt material insert — until the fixed contact touches against the stop, and that assured contact opening takes place due to the high directional forces inherent in the moving contact spring. The invention utilizes the available spring force range to an optimum degree, in order to guarantee assured, sudden opening of the contact elements.

Furthermore, the invention achieves the result that the switches can be stressed with higher current forces, a current load of up to 16 A can be switched without problems by such thermoswitches.

Surprisingly, it is even possible to turn a disadvantage in the state of the art into an advantage by the spring dimensioning according to the invention, because cold welding can be intentionally induced by materials which tend towards cold welding, which has the result that the contact pair "sticks together" at first, during the common swing movement, and that extremely rapid opening of the contact distance occurs due to the breaking or tearing of the cold welding zone, which improves the switching performance of the switch.

The intentional cold welding is also advantageous in that no change of the contact resistance takes place over extended periods of time, in other words within the service life as provided.

The invention is described in greater detail on the basis of advantageous embodiments shown in the drawings. These are:

Figure 1:
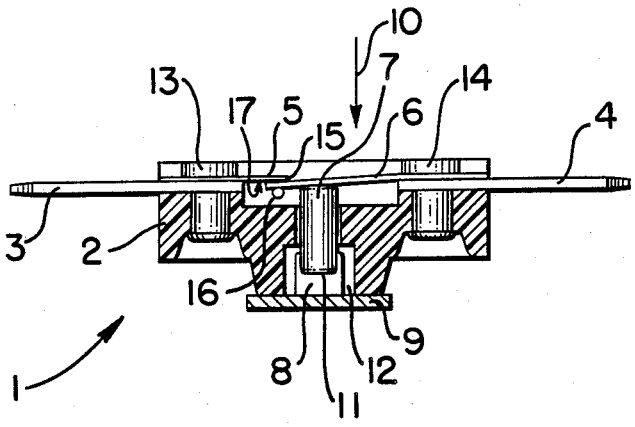
FIG. 1 shows a cross-section through a temperature safety device in the closed state.
Figure 2:
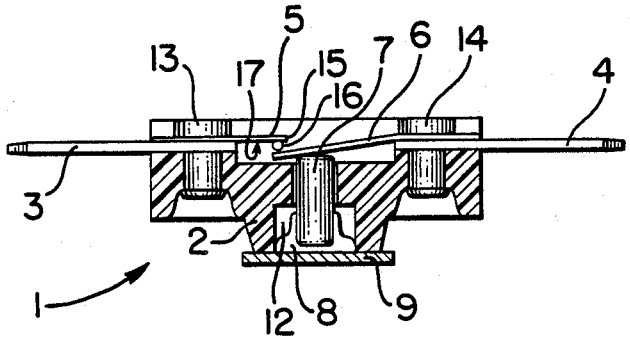
FIG. 2 shows the cross-section of FIG. 1, switch opened.

The temperature safety device 1 shown in FIG. 1 and 2 essentially consists of an insulating part 2 with electrical connections 3, 4 and contact elements, namely a fixed contact 5 and a moving contact 6, which is kept in the contact closing position by means of a mechanical transfer element 7. The transfer element 7 rests against a melt material insert 8, which serves as a thermal trigger and is connected with a heat source, not shown in detail, via a heat transfer plate 9. The fixed contact 5 and the moving contact 6 are under tension stress in the direction of the arrow 10, the moving contact is held in the contact closing position and the necessary contact closing pressure is applied against the tension stress directed in the direction of the arrow 10, so that pressure is constantly exerted against the melt material insert 8, which presses the frontal surface 11 of the insert against the interior side of the heat transfer plate 9, which side faces a housing chamber 12.

As is further evident from FIG. 1, the connections 3, 4, which are formed as flat plugs, as well as the contacts 5, 6, are attached on/in the housing by rivets 13, 14.

As is indicated by the thickness of the lines used in the drawings, the fixed contact 5 is formed as a thin, soft spring contact, and has a significantly lower directional quantity at its free contact end 1, within the elastic bending range, than the hard spring moving contact 6.

Furthermore, FIG. 1 shows a stop 16 which serves to limit the movement of the fixed contact 5 when the contact distance is opened, and which acts together with the side 17 of the fixed contact which faces the melt material insert 8. When the fixed contact of the temperature safety device is mentioned, this does not mean that the contact is actually fixed, but rather that the fixed contact, in contrast to the moving contact, is not actively driven by the transfer element. The fixed contact only gives way resiliently, under the influence of the moving contact.

Figure 3:
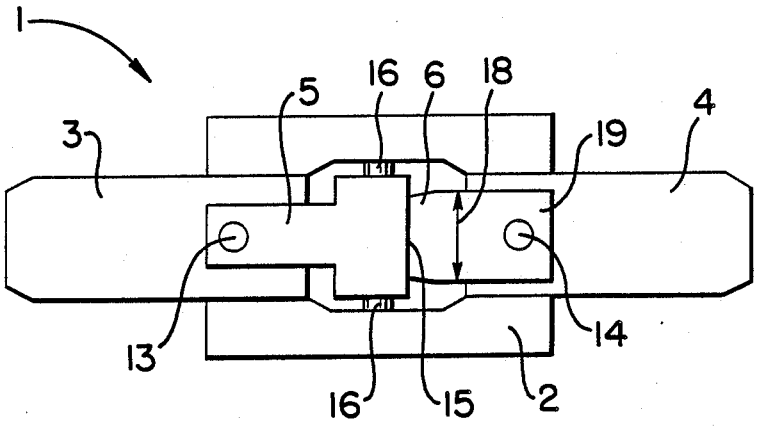
FIG. 3 shows a top view of a temperature safety device with the fixed contact installed.
Figure 5:
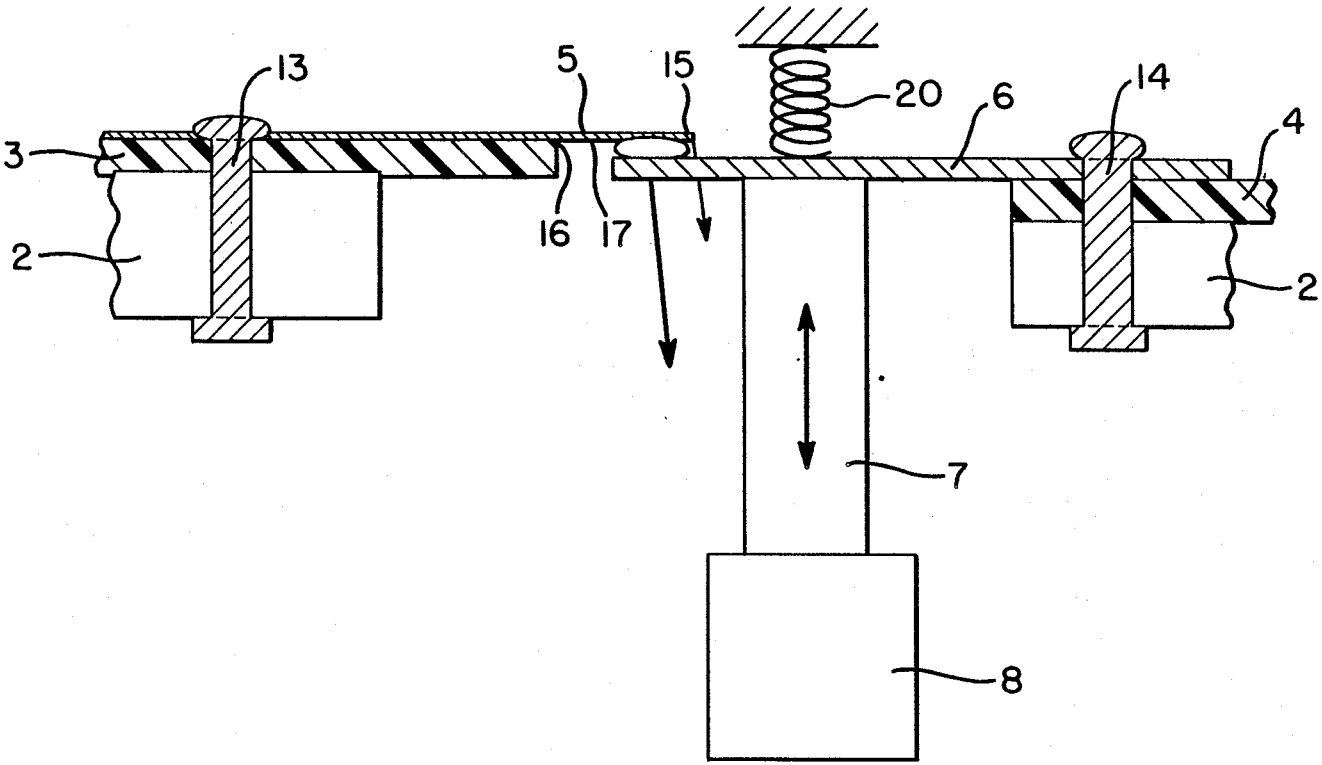
FIG. 5 shows an enlarged view of another embodiment of the contacts.

As far as the dimensioning of the directional quantities of the moving contact and the fixed contact is concerned, the directional quantity of the moving contact is about twice as great as the directional quantity of the fixed contact. This can basically be achieved by selecting the effective spring length of the fixed contact to be greater than that of the moving contact. However, this is not the solution in FIG. 1 and 2, where the directional quantity of the moving contact as compared with the fixed contact is increased by increasing the cross-section 18 in the area of the fixed end 19 of the moving contact. (FIG. 3). In principle, the directional quantity of the moving contact as compared with the fixed contact can also be increased by other measures, for example by an additional spring element 20, as indicated in FIG. 5.

There are also various design possibilities for the structural form of the stop which acts together with the moving contact side 17 facing the melt material insert 8. In FIG. 1 and 2, the stop 16 is formed as a housing tab which interlocks on both sides under the fixed contact 5, with the fixed contact having a T-shaped widening 21 at its free contact end 15, which rests against the housing tabs with the cross-ends of the T (stops 16).

Another possibility of forming a stop (16) is to extend the connection 3 which is riveted together with the fixed contact 5 into the contact area, causing the fixed contact 5, which is formed as a spring, to make contact only with its bottom side, i.e. the side facing the melt material insert, and to be limited in its movement, but in such a way that it can spring away freely on its side which faces away from the melt material insert. Such a design variation is also shown in FIG. 5. In some circumstances, it is also practical to make the stop adjustable, which makes it possible to influence the switching behavior of the temperature safety device in a targeted manner.

Figure 4:
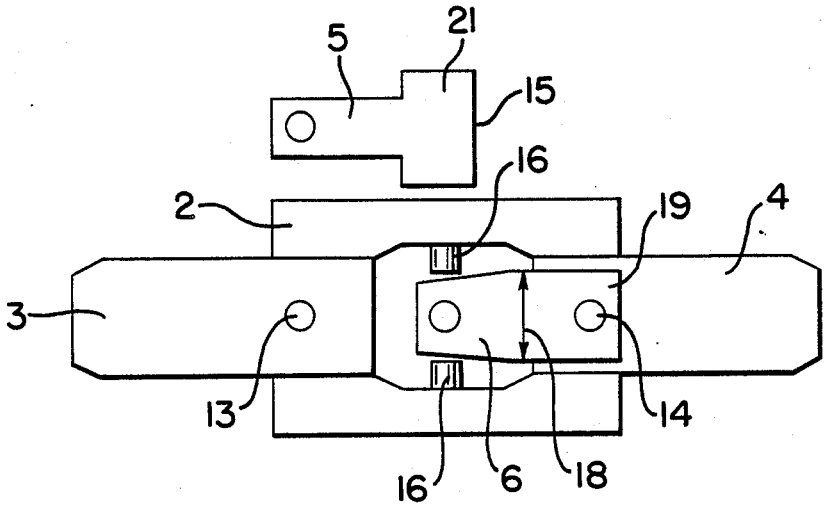
FIG. 4 shows the top view of FIG. 3, with the fixed contact removed and separate.

FIG. 3 and 4 show once again how the stop, which can be seen in FIG. 1 and 2 and is formed as a housing tab, acts together with the T-shaped widening 21 of the contact end 15 of the fixed contact 5. In FIG. 4, the fixed contact has been removed from its rivet holder, so that it can clearly be seen how the contact end of the moving contact 6 is able to move between the housing tabs which form the stop 16. The distance between the contact point on the one hand and the stops on the other hand is very small, so that very direct force on the fixed contact and therefore very sudden breaking of any cold welds which might exist takes place, which has an overall positive effect on the shut-off behavior of the device.

Figure 6:
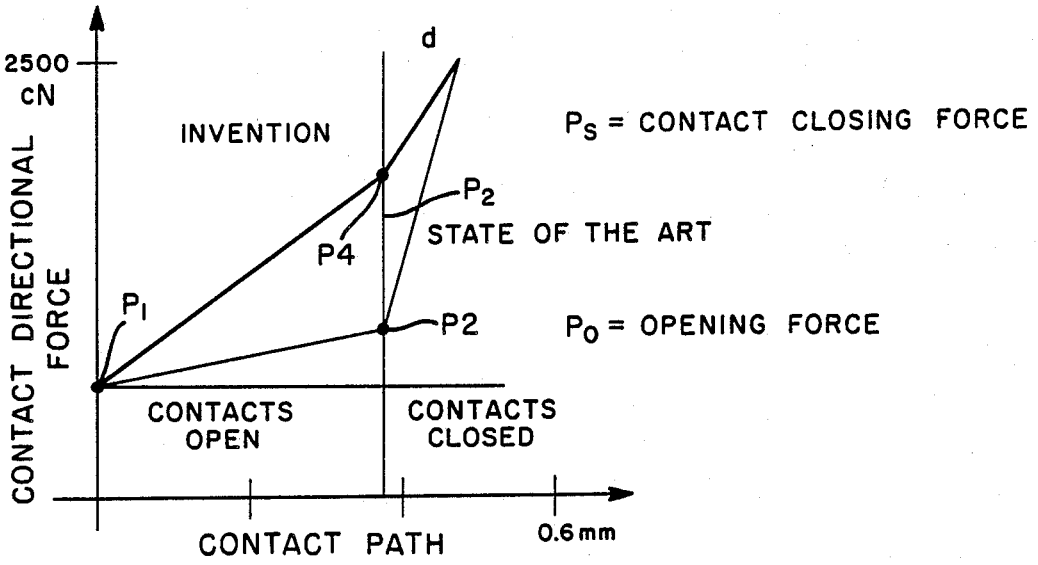
FIG. 6 shows a force-path diagram to represent the force-path ratios which occur.

FIG. 6 shows a force-path diagram, using which the spring force conditions prevailing in the temperature safety device can easily be studied.

First of all, with regard to the state of the art: At Point 1 of the diagram, the contact is open, the fixed contact rests against a housing part with a force $P_1$, as is clearly evident in FIG. 2, for example. If the moving contact is now pressed upward through a certain contact path, by the transfer element 7, the force line rises in a relatively flat manner in the state of the art, since moving contacts with a relatively low directional quantity were generally used in such switches. At Point 2, the moving contact spring touches the fixed contact with its contact nipple, and carries it along in an upward direction for a certain distance, which causes the directional forces or directional quantities in both springs to be added, so that the directional force line increases steeply up to a maximum permissible value, which depends on the type and construction of the melt material insert. If a melt material insert gives way slightly, due to the aging process, for example by the amount d, the switch according to the state of the art does remain closed, but because of the flow movement, a significant amount of the available directional force is wasted, and no force remains available to break cold-welded contacts.

The upper, heavy line shows a directional force-contact path behavior according to the invention. Since the moving contact has a much higher directional force than the fixed contact, the force acting on the melt material insert will increase relatively greatly already when the moving contact is moved, until the contact is closed (Point 4), further increase of the directional force is not as striking as in the state of the art, since the directional force of the fixed contact as compared with the moving contact is relatively slight. A slight increase in the incline of the directional force line can be determined.

The "breaking force" which is available in the temperature safety device according to the invention, as compared with a temperature safety device according to the state of the art, is designated with $P_2$ as the difference of Points 2 and 4, this force difference is sufficient to break even relatively strong contact welding and to guarantee assured contact opening. The device according to the invention exhibits an opening force on the switch on melting of the insert which is in the range of from about 1,500 cN (centinewtons) to 2,200 cN wherein the closing force on the switch absent such melting is about 300 cN.

I claim:

1. In a temperature safety device of the type having an electrically insulative support, electrical connectors extending outwardly of the support, first and second contact elements having first fixed ends connected with said electrical connectors and free ends engageable to provide a switch within the support in series circuit with said electrical connectors, a melt material insert adapted for heat transfer relative with apparatus being protected by the safety device, and a mechanical force transfer element disposed between said insert and said second contact element and applying force thereto to effect closure of said contact elements in part attributable to counter-forces exerted by said contact elements, the improvement wherein said device first contact element has a lower directional quantity at its free end that the directional quantity of said second contact element at its free end, and wherein said device includes stop means disposed by said support in confronting relation with said first contact element and coactive therewith upon melting of said insert to limit movement of said first contact element, thereby to enhance opening of said switch and interruption of said series circuit.

2. The invention claimed in claim 1 wherein the directional quantity of said second contact element is about twice as great as the directional quantity of said first contact element.

3. The invention claimed in claims 1 or 2 wherein said first and second contact elements are elongate and wherein the spring length of said first contact element is greater than the spring lengthy of said second contact element.

4. The invention claim in claims 1 or 2 wherein said first and second contact elements are elongate and wherein the directional quantity of said second contact element is increased with respect to that of said first contact element by increasing the transverse cross-section of said second contact element with respect to that of said first contact element in the vicinity of said fixed ends thereof.

5. The invention claimed in claims 1 or 2 wherein said device further includes a spring element in biasing relation with said second contact element, whereby the directional quantity of said second contact element is increased with respect to that of said first contact element.

6. The invention claimed in claims 1 or 2 wherein said stop means comprises a tab mounted on said support and extending in underlying relation to said first contact element across at least one side of said first contact element.

7. The invention claimed in claims 1 or 2 wherein said stop means comprises a tab mounted on said support, said first contact element being of T-shape configuration at its free end and having an end of such T-end disposed on said tab.

8. The invention claimed in claims 1 or 2 wherein said stop means comprises first and second tags mounted on said support and extending in underlying relation to said first contact element across at respective opposite sides of said first contact element.

9. The invention claimed in claims 1 or 2 wherein said stop means comprises first and second tabs mounted on said support, said first contact element being of T-shape configuration at its free end and having ends of such T-end respectively disposed on said first and second tabs.

10. The invention claim in claims 1 or 2 wherein said device exhibits a opening force on said switch on melting of said insert which is greater than three times the closing force on said switch absent such melting.

11. The invention claimed in claims 1 or 2 wherein said device exhibits an opening force on said switch on melting of said insert which is in the range of from about 1,500 cN to 2,200 cN and wherein the closing force on said switch absent such melting is about 300 cN.

12. The invention claimed in claims 1 or 2 wherein said stop means is positionally adjustable with respect to said first contact element.

13. The invention claimed in claims 1 or 2 wherein said stop means includes an adjusting screw interlockably disposed in underlying relation to said first contact element.

* * * * *